US006419027B1

(12) United States Patent
Tapscott

(10) Patent No.: US 6,419,027 B1
(45) Date of Patent: Jul. 16, 2002

(54) FLUOROALKYLPHOSPHORUS COMPOUNDS AS FIRE AND EXPLOSION PROTECTION AGENTS

(75) Inventor: Robert E. Tapscott, Albuquerque, NM (US)

(73) Assignee: GlobeTech Inc., Albuquerque, NM (US)

( * ) Notice: Subject to any disclaimer, the term of this patent is extended or adjusted under 35 U.S.C. 154(b) by 0 days.

(21) Appl. No.: 09/666,488

(22) Filed: Sep. 18, 2000

Related U.S. Application Data

(60) Provisional application No. 60/155,278, filed on Sep. 20, 1999.

(51) Int. Cl.[7] ..... A62C 2/100; A62C 3/00

(52) U.S. Cl. ..... 169/46; 169/45; 169/47; 169/43

(58) Field of Search ..... 169/43, 45, 46, 169/47, 29, 16

(56) References Cited

U.S. PATENT DOCUMENTS 4,373,588 A * 2/1983 White et al. ..... 169/26
4,664,197 A * 5/1987 Leduc et al. ..... 169/26
4,718,497 A * 1/1988 Moore et al. ..... 169/46
5,163,517 A * 11/1992 Kozai et al. ..... 169/46

FOREIGN PATENT DOCUMENTS

DE 19839292 A1 * 3/2000

OTHER PUBLICATIONS

Lederle et al., Fluoroalkyl Phosphonitrilates, a New Class of Potential Fire–Resistant Hydraulic Fluids and Lubricants, Apr. 1966, Journal of Chemical and Engineering Data, vol. 11, No. 2, pp. 221–228).*

* cited by examiner

*Primary Examiner*—William Doerrler
*Assistant Examiner*—Davis Hwu
(74) *Attorney, Agent, or Firm*—R W Becker & Associates; R W Becker

(57) ABSTRACT

A set of fluoroalkylphosphorus agents for extinguishment of fires, suppression of explosions, and inertion against fires and explosions is disclosed. Specifically disclosed are agents based on fluoroalkyl esters of phosphorus-containing acids.

10 Claims, No Drawings

FLUOROALKYLPHOSPHORUS COMPOUNDS AS FIRE AND EXPLOSION PROTECTION AGENTS

This application claims priority from provisional application Ser. No. 60/155,278, filed Sep. 20, 1999.

GOVERNMENT RIGHTS

This invention was made under contract with the U.S. Government, which has certain rights therein.

FIELD OF THE INVENTION

The invention described and claimed herein is generally related to chemical agents used for fire extinguishment, explosion suppression, explosion inertion, and fire inertion and more particularly, to extinguishing, suppressing, and inerting fluoroalkylphosphorus agents that are replacements for halon fire and explosion suppressants and extinguishants. The production of halons has been eliminated or curtailed in many nations due to their impact on stratospheric ozone.

BACKGROUND OF THE INVENTION AND PRIOR ART

The broad class of halocarbons consists of all molecules containing carbon and one or more of the following halogen atoms: fluorine, chlorine, bromine, and/or iodine. Halocarbons may also contain other chemical features such as hydrogen atoms, carbon-to-carbon multiple bonds, or aromatic rings. Haloalkanes, a subset of halocarbons, contain only single bonds between the carbon atoms. The use of certain haloalkanes as fire extinguishing agents has been known for many years.

For example, fire extinguishers containing carbon tetrachloride and methyl bromide were used in aircraft applications as early as the 1920s. Over a period of years the high toxicity of these compounds was recognized and they were replaced with less toxic compounds. Chlorobromomethane was used in aircraft applications from the 1 950s to the 1 970s. A major study of haloalkanes as fire extinguishing agents was conducted by the Purdue Research Foundation for the U.S. Army from 1947 to 1950 (FIRE EXTINGUISHING AGENTS, Final Report, Purdue University, 1950). Haloalkanes used for fire protection are often designated by the "halon numbering system." This system gives in order the number of atoms of carbon, fluorine, chlorine, and bromine in the molecule. Thus, for example, CBrCIF2, whose chemical name is bromochlorodifluoromethane, is often referred to as Halon 1211.

The term "extinguishment" is usually used to denote complete elimination of a fire; whereas, "suppression" is often used to denote reduction, but not necessarily total elimination, of a fire or explosion. These two terms are sometimes used interchangeably. There are four general types of halocarbon fire and explosion protection applications. (1) In total-flood fire extinguishment and/or suppression applications, the agent is discharged into a space to achieve a concentration sufficient to extinguish or suppress an existing fire. This is often, though not always, done by an automatic system, which detects the fire and then automatically discharges the extinguishing agent to fill the space with the concentration of a gaseous or an evaporated volatile liquid agent to the concentration needed to suppress or extinguish the contained fire. Total flooding use includes protection of enclosed, potentially occupied spaces such as computer rooms as well as specialized, often unoccupied spaces such as aircraft engine nacelles and engine compartments in vehicles. Note that the term "total flood" does not necessarily mean that the extinguishing or suppressing agent is uniformly dispersed throughout the space protected. (2) In streaming applications, the agent is applied directly onto a fire or into the region of a fire. This is usually accomplished using manually operated wheeled or portable units. A second method, which we have chosen to include as a streaming application, uses a "localized" system, which discharges agent toward a fire from one or more fixed nozzles. Localized systems may be activated either manually or automatically. (3) In explosion suppression, a halocarbon is discharged to suppress an explosion that has already been initiated. The term "suppression" is normally used in this application since the explosion is usually self-limiting. However, the use of this term does not necessarily imply that the explosion is not extinguished by the agent. In this application, a detector is usually used to detect an expanding fireball from an explosion, and the agent is discharged rapidly to suppress the explosion. Explosion suppression is used primarily, but not solely, in defense applications. (4) In inertion, a halocarbon is discharged into a space to prevent an explosion or a fire from being initiated. Often, a system similar or identical to that used for total-flood fire extinguishment or suppression is used. Inertion is widely used for protection of oil production facilities at the North Slope of Alaska and in other areas where flammable gases or explosive dusts may build up. Usually, the presence of a dangerous condition (for example, dangerous concentrations of flammable or explosive gases) is detected, and the halocarbon is then discharged to prevent the explosion or fire from occurring until the condition can be remedied.

Thus, there are four fire and explosion protection applications covered by this disclosure:

1. Total-Flood Fire Extinguishment and Suppression
2. Streaming Fire Extinguishment and Suppression
3. Explosion Suppression
4. Explosion and Fire Inertion The halogenated chemical agents currently in use for fire extinguishment (by total flooding or streaming), explosion suppression, explosion inertion, and fire inertion are generally bromine-containing haloalkanes. Such chemicals contain bromine, fluorine, and carbon (and, in at least one case, chlorine), contain no hydrogen atoms, and have only single bonds between atoms. These chemicals include Halon 1202 ($CBr_2F_2$), Halon 1211 ($CBrCIF_2$), Halon 1301 ($CBrF_3$), and Halon 2402 ($CBrF_2CBrF_2$). Information on the most important of the existing halons are shown in Table I. The "CAS No." is the number assigned by the Chemical Abstract Services of the American Chemical Society to aid in identifying chemical compounds. Halon 1301 (bromotrifluoromethane) and Halon 1211 (bromochlorodifluoromethane) are the most widely used haloalkane fire extinguishing agents. Halon 1301 is widely used for total-flood fire extinguishment, explosion suppression, and inertion. Due to its higher boiling point and higher toxicity, Halon 1211 is usually not used in total-flood applications, but, it is widely used in streaming.

TABLE I

EXISTING HALONS.

| Name | Formula | Halon No. | CAS No. | Boiling Point, ° C. |
|---|---|---|---|---|
| dibromodifluoromethane | $CBr_2F_2$ | 1202 | 75-61-6 | 24.5 |
| bromochlorodifluoromethane | $CBrClF_2$ | 1211 | 353-59-3 | −4 |
| bromotrifluoromethane | $CBrF_3$ | 1301 | 75-63-8 | −58 |
| 1,2-dibromotetrafluoroethane | $CBrF_2CBrF_2$ | 2402 | 124-73-2 | 47 |

Bromine-containing haloalkanes such as the existing halons operate as fire extinguishing agents by a complex chemical reaction mechanism involving the disruption of free-radical chain reactions, which are essential for continuing combustion. The existing halons are desirable as fire extinguishing agents because they are effective, because they leave no residue (i.e., they are liquids that evaporate completely or they are gases), and because they do not damage equipment or facilities to which they are applied.

Recently, however, halons, have come to be recognized as serious environmental threats due to their ability to cause stratospheric ozone depletion. In the United States, production of the existing halons (Halon 1201, Halon 1301, Halon 121 1, and Halon 2402) stopped at the end of 1993.

Much research has gone on to find replacements for the existing halons for protection against fires and explosions; however, the search for halon replacements has been less than totally successful ("Pressure Mounts As Search for Halon Replacements Reaches Critical Phase," Chemical and Engineering News, Sep. 19,1994, pp. 29–32). Most of the agents now being promoted as halon replacements are hydrochlorofluorocarbons (HCFCs), hydrofluorocarbons (HFCs), and perfluorocarbons (FCs or PFCs). HCFCs, HFCs, and FCs (PFCs) appear to operate primarily by heat absorption, which is a less effective mechanism for most fire and explosion protection applications than the free radical chain disruption mechanism used by the existing halons. Thus, HCFCs, HFCs, and FCs (a family that we refer to as "first-generation" halon replacements) have a significantly decreased effectiveness compared to the halons now used for fire and explosion protection in most applications. Moreover, the HCFCs have a sufficiently large ODP that their production is restricted and will eventually be phased out under both the Montreal Protocol and the U.S. Clean Air Act. Finally, the HFCs and, in particular, the FCs have significant atmospheric lifetimes (usually on the order of years or even hundreds of years) and are believed to cause global warming. This may cause eventual restrictions on the HFCs and FCs.

Accordingly, it is the object of the present invention to provide effective fire extinguishing, fire suppression, explosion suppression, and explosion and fire inertion agents that contain, as principal components, phosphorus compounds containing fluoroalkyl groups. The term "agent" here means either a single compound or mixtures of two or more compounds and may include mixtures of fluoroalkylphosphorus compounds with other materials.

Phosphorus compounds have long been known as extinguishing agents. A review has been presented in Tapscott, R. E., Mather, J. D., Heinonen, E. W., Lifke, J. L., and Moore, T. A., *Identification and Proof Testing of New Total Flooding Agents: Combustion Suppression Chemistry and Cup Burner Testing*, Final Report, NMERI Report No. 97/6/33010, U.S. Department of Defense, Strategic Environmental Research and Development Program and Defense Advance Research Projects Agency, Arlington, Va., May 1998. Among the compounds found to be most effective are esters of phosphorus-containing acids. One example is dimethylmethylphosphonate ($O{=}P(CH_3)(OCH_3)_2$), which has been disclosed MacDonald, M. A., Jayaweera, T. M., Fisher, E. M., and Gouldin, F. C., "Inhibited Counterflow Non-Premixed Flames with Variable Stoichiometric Mixture Fractions," *Proceedings, Chemical and Physical Processes in Combustion*, 1997 *Fall Technical Meeting, The Eastem States Section of the Combustion Institute*, Hartford, Conn., 27–29 Oct. 1997, pp. 91–94. However, most, if not all, of the phosphorus esters studied to date are flammable and have very low volatilities. The use of fluoroalkyl groups, rather than unsubstituted alkyl groups, decreases or eliminates the flammability and increases the volatility. This is the basis of the present invention.

SUMMARY OF THE INVENTION

The present invention provides fluoroalkylphosphorus compounds for use as agents for fire extinguishing and suppression (in either total-flooding or streaming application), explosion suppression, and explosion and fire inertion. As the term is used in this application, fluoroalkylphosphorus compounds are any compounds containing a direct (covalent) bond between a fluoroalkyl group and a phosphorus atom. Alkyl groups are groups containing only carbon and hydrogen atoms such as methyl ($—CH_3$), ethyl ($—CH_2CH_3$), n-propyl ($—CH_2CH_2CH_3$), and iso-propyl ($CH(CH_3)_2$). Fluoroalkyl groups are alkyl groups in which one or more of the hydrogen (H) atoms have been replaced by other atoms or groups. Examples are $—CH_2F$, $—CHF_2$, and $—CF_3$. Here, however, we use the term "fluoroalkyl" to denote any alkyl group containing at least one fluorine atom even though other substituents, including other halogen atoms and hydrogen atoms, may be present.

Fluoroalkylphosphorus compounds specifically include fluoroalkyl derivatives of the four phosphorus-containing acids shown below. Note that phosphorus acid does not exist; however, certain derivatives of this hypothetical compound do exist. Of particular importance are esters of these acids. Esters are compounds in which one or more of the hydrogen atoms in hydroxy (OH) groups have been replaced by an organic group. We are particularly interested in esters in which a fluoroalkyl group replaces one or more of the hydrogen atoms of a hydroxyl group.

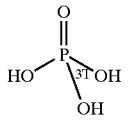

Phosphoric (Orthophosphoric) Acid

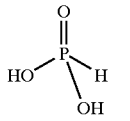

Phosphonic Acid

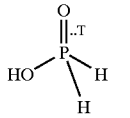

Phosphonic Acid

-continued

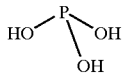

Phosphorous Acid (Hypothetical)

For example, replacement of the hydrogen atoms in phosphoric acid by a fluoroalkyl group $R_f$ can give three different "phosphate" esters: a fluoroalkyldihydrogenphosphate, a bis(fluoroalkyl) hydrogenphosphate, and a tris(fluoroalkyl)phosphate as shown below. Mixed compounds containing two or three different fluoroalkyl groups or fluoroalkyl groups combined with non-fluorinated alkyl groups are also possible.

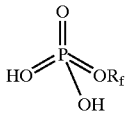

Fluoroalkyldihydrogenphosphate

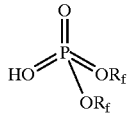

Bis(fluoroalkyl)hydrogenphosphate

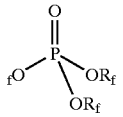

Tris(fluoroalkyl)phosphate

Similarly, there are three different fluoroalkyl esters of (the hypothetical) phoshorous acid: a fluoroalkyldihydrogenphosphite, a bis(fluoroalkyl) hydrogenphosphite, and a tris(fluoroalkyl)phosphite as shown below. Again, compounds containing mixed substituents are possible.

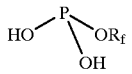

Fluoroalkyldihydrogenphosphite

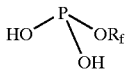

Bis(fluoroalkyl)hydrogenphosphite

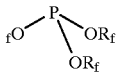

Tris(fluoroalkyl)phosphite

A list of some specific fluoroalkyl compounds is shown in Table II. In some cases, a specific compound may not, as yet, have been synthesized. However, this does not mean that such a compound is impossible.

TABLE II

SOME S .3 ELECTED FLUOROALK LPHOSPHORUS COMPOUNDS.

| Formula | Name |
|---|---|
| $P(OCH_2CF_3)_3$ | tris(2,2,2-trifluoroethyl)phosphite |
| $P(OCF_3)_3$ | tris(trifluoromethyl)phosphite |
| $O = P(OCF_3)_3$ | tris(trifluoromethyl)phosphate |

Description of Preferred Embodiments

These and other aspects of the present invention will be more apparent upon consideration of the following detailed description of the invention.

The cup burner is a widely accepted laboratory test apparatus for determining the fire extinguishing and suppressing effectiveness of agents. In this method, an agent is introduced into a stream of air which passes around a cup of burning liquid fuel, and the concentration of gaseous agent needed to extinguish the flame is determined. During this operation, any agent that is normally a liquid is allowed to become a gas before being mixed into the stream of air and passed by the burning liquid fuel. The cup burner is so widely accepted that the National Fire Protection Association (NFPA) Standard 2001 on Clean Agent Fire Extinguishing Systems mandates this method as the primary procedure for determining the concentration needed to extinguish a fire of liquid hydrocarbon fuels (e.g., gasoline, hexane, etc; such fires are termed "Class B fires"). That standard states that "The minimum design concentration for Class B flammable liquids shall be a demonstrated extinguishing concentration plus a 20 percent safety factor. Extinguishing concentration shall be demonstrated by the cup burner test." Concentrations are usually expressed as "percent by volume." This is the same as the "percent by gas volume," which is calculated assuming that all of the introduced agent has volatilized (i.e., vaporized to become a gas).

A halocarbon carrier may be added to one or more of the fluoroalkylphosphorus compounds to aid in distribution of the agent, to modify the physical properties, or to provide other benefits. Mixtures of halocarbon carriers with fluoroalkylphosphorus compounds may be either zeotropes, which do not change in composition as they evaporate, or (more zeotropes, which do change in composition during volatile components tend to evaporate preferentially). Mixtures that change only slightly in composition during evaporation are sometimes termed "near azeotropes." In some cases, there are advantages to azeotropes and near azeotropes. Mixtures covered by this application include azeotropes, near azeotropes, and zeotropes.

Carriers can be materials such as hydrochlorofluorocarbons, hydrofluorocarbons, or perfluorocarbons. Hydrochlorofluorocarbons (HCFCs) are chemicals containing only hydrogen, chlorine, fluorine, and carbon. Examples of HCFCs that could be used as carriers are 2,2-dichloro-1,1,1-trifluoroethane ($CHCl_2CF_3$), chlorodifluoromethane ($CHClF_2$), 2-chloro-1,1,1,2-tetrafluoroethane ($CHClFCF_3$), and 1-chloro-1,1-difluoroethane ($CH_3CClF_2$). Hydrofluorocarbons (HFCs) are chemicals containing only hydrogen, fluorine, and carbon. Examples of potential HFC carriers are trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1,1,2,2,3,3-heptafluoropropane ($CF_3CF_2CF_2H$), 1,1,1,2,3,3,3-heptafluoropropane ($CF_3CHFCF_3$), and 1,1,1 ,4,4,4-hexafluorobutane ($CF_3CH_2CH_2CF_3$). Perfluorocarbons, which contain only fluorine and carbon, are characterized by very low toxicities. Examples of perfluorocarbons that could be used as carriers are tetrafluoromethane ($CF_4$), hexafluoroethane ($CF_3CF_3$), octafluoropropane ($CF_3CF_2CF_3$), decafluorobutane ($CF_3CF_2CF_2CF_3$), dodecafluoropentane ($CF_3CF_2CF_2CF_2CF_3$), and tetradecafluorohexane ($CF_3CF_2CF_2CF_2CF_2CF_3$). Ourwork indicates that some mixtures possess flame extinguishment and suppression ability greater than would be predicted from the intrinsic fire suppression ability of the separate components, a phenomenon that we term "synergism." Note that it is not necessary that the carrier have zero flammability. It is only necessary that the mixture of carrier(s) and fluoroalkylphosphorus agent(s) act as a fire and/or explosion protection agent.

The embodiments include the use of agents comprised of fluoroalkyl phoshorus compounds, with or without carriers, for the four applications of fire extinguishment or suppression using a total-flood application, fire extinguishment or suppression using a streaming application, explosion suppression, and inertion against fires and explosions. The following example illustrates the fire and explosion protection in accordance with the invention.

EXAMPLE 1

Into a flowing air stream in which a cup of burning n-heptane fuel is contained was introduced tris(2,2,2-trifluoroethyl) phosphite ($P(OCH_2CF_3)_3$) sufficient to raise the concentration to 1.69 percent agent by gas volume. This concentration of agent was 56 percent as much as required to extinguish the same fire using Halon 1301, which required a concentration of 3.0 percent.

The present invention has been described and illustrated with reference to certain preferred embodiments. Nevertheless, it will be understood that various modifications, alterations and substitutions may be apparent to one of ordinary skill in the art, and that such modifications, alterations and substitutions may be made without departing from the essential invention. Thus, the present invention is, of course, in no way restricted to the specific disclosure of the specification and examples, but also encompasses any modifications within the scope of the appended claims. Accordingly, the present invention is defined by the following claims.

What we claim is:

1. A method of extinguishing or suppressing a fire in a total-flood or streaming application, or of suppressing an explosion or inerting an area to prevent a fire or explosion, including the steps of:

a) providing an agent containing at least one fluoroalkylphosphorus compound;

b) disposing said agent in a pressurized discharge system, and c) discharging said agentfrom said system to extinguish or suppress a fire, to suppress an explosion or to prevent a fire from occurring.

2. A method according to claim 1, wherein said agent comprises at least one fluoroalkyl ester of one or more of the compounds phosphoric acid, phosphonic acid, phosphinic acid, and phosphorous acid.

3. A method according to claim 2, wherein said fluoroalkyl is selected from the group consisting of $CH_2F$, $CHF_2$, $CF_3$, $CH_2CH_2F$, $CH_2CHF_2$, $CH_2CF_3$, $CHFCF_3$, and $CF_2CF_3$.

4. A method according to claim 1, which includes the step of adding to said agent a carrier comprised of one or more halocarbons.

5. A method according to claim 4, wherein said at least one halocarbon is selected from the group consisting of hydrochlorofluorocarbons, hydrofluorocarbons, and perfluorocarbons.

6. A method according to claim 5, wherein said hydrochlorofluorocarbons, hydrofluorocarbons, and perfluorocarbons contain 1 through 10 carbon atoms.

7. A method according to claim 6, wherein said at least one halocarbon is selected from the group consisting of 2,2-dichloro- 1,1,1-trifluoroethane ($CHCl_2CF_3$), chlorodifluoromethane ($CHClF_2$), 2-chloro-1,1,1 ,2-tetrafluoroethane ($CHClFCF_3$), 1-chloro-1,1-difluoroethane ($CH_3CClF_2$), trifluoromethane ($CHF_3$), difluoromethane ($CH_2F_2$), 1,1-difluoroethane ($CH_3CHF_2$), pentafluoroethane ($CHF_2CF_3$), 1,1,1,2-tetrafluoroethane ($CH_2FCF_3$), 1,1,1 ,2,2-pentafluoropropane ($CF_3CF_2CH_3$), 1,1,1,2,3,3-hexafluoropropane ($CF_3CHFCHF_2$), 1,1,1,3,3,3-hexafluoropropane ($CF_3CH_2CF_3$), 1,1, 1,2,2,3,3-heptafluoropropane ($CF_3CF_2CF_2H$), 1,1,1,2,3,3,3-heptafluoropropane ($CF_3CHFCF_3$), 1,1,1 ,4,4,4-hexafluorobutane ($CF_3CH_2CH_2CF_3$), tetrafluoromethane ($CF_4$), hexafluoroethane ($CF_3CF_3$), octafluoropropane ($CF_3CF_2CF_3$), decafluorobutane ($CF_3CF_2CF_2CF_3$)$_1$ dodecafluoropentane ($CF_3CF_2CF_2CF_2CF_3$), and tetradecafluorohexane ($CF_3CF_2CF_2CF_2CF_2CF_3$).

8. A method according to claim 1, wherein said discharging step comprises discharging said agent into an area to provide an average resulting concentration in said area of between 0.1 and 12 percent by gas volume to extinguish or suppress a fire in said area.

9. A method according to claim 1, wherein said discharging step comprises discharging said agent into an area to provide an average resulting concentration in said area of between 1 and 13 percent by gas volume to prevent a fire or an explosion from occurring in said area.

10. A method according to claim 1, which includes, prior to said discharging step, the step of detecting an explosion, wherein said discharging step comprises discharging said agent into an area to provide an average resulting concentration in said area of between 0.3 and 50 percent by gas volume to suppress an explosion.

* * * * *